US006917282B2

(12) United States Patent
Giegerich

(10) Patent No.: US 6,917,282 B2
(45) Date of Patent: Jul. 12, 2005

(54) TOUCH PAD SCORING APPARATUS FOR DART GAMES

(75) Inventor: Gary D. Giegerich, Fort Washington, PA (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 10/720,926

(22) Filed: Nov. 24, 2003

(65) Prior Publication Data

US 2004/0121855 A1 Jun. 24, 2004

Related U.S. Application Data

(60) Provisional application No. 60/435,574, filed on Dec. 19, 2002.

(51) Int. Cl.[7] ..... G08B 23/00

(52) U.S. Cl. ..... 340/323 R; 273/376; 700/92

(58) Field of Search ..... 273/371–376, 273/1, 85; 340/323 R, 323; 700/91, 92, 93; 463/1–9, 37, 47; 364/410, 411

(56) References Cited

U.S. PATENT DOCUMENTS 3,604,707 A * 9/1971 Hurley ..... 463/49
4,567,461 A * 1/1986 Honekman et al. ..... 340/323 R
4,824,121 A * 4/1989 Beall et al. ..... 273/376
5,004,247 A * 4/1991 Menke ..... 273/376
5,114,155 A * 5/1992 Tillery et al. ..... 273/371
5,156,643 A * 10/1992 Grubek ..... 273/376
5,370,306 A * 12/1994 Schulze et al. ..... 463/25
5,384,561 A * 1/1995 Smith ..... 340/323 R
5,559,490 A * 9/1996 McDonald et al. ..... 340/323 R
5,560,617 A * 10/1996 Liang ..... 273/376
5,648,752 A * 7/1997 Alfrey ..... 340/323 R
5,662,333 A * 9/1997 Allen ..... 273/371
5,743,534 A * 4/1998 Pan ..... 273/371
5,755,443 A * 5/1998 Huang ..... 273/371
5,934,677 A * 8/1999 Yiu ..... 273/371
5,971,397 A * 10/1999 Miguel et al. ..... 273/371
6,076,021 A * 6/2000 Houriet, Jr. et al. ..... 700/93
6,279,912 B1 * 8/2001 Martin et al. ..... 273/371
6,322,365 B1 * 11/2001 Shechter et al. ..... 434/21
6,439,576 B1 * 8/2002 Montague ..... 273/371

* cited by examiner

*Primary Examiner*—Michael O'Neill
(74) *Attorney, Agent, or Firm*—Akin Gump Strauss Hauer & Feld, L.L.P.

(57) ABSTRACT

A touch pad scoring apparatus for a dart game includes a touch pad mounted on a housing. The touch pad is has a plurality of segments. Each touch pad segment has a pressure-sensitive sensor operatively connected to a controller. A user applies pressure, for example with a stylus or a finger, to at least one segment corresponding to the dart board segment impacted by a thrown dart. The scoring apparatus has a memory and displays which allow the apparatus to track and display the scores of multiple players though the course of the dart game.

15 Claims, 4 Drawing Sheets

TOUCH PAD SCORING APPARATUS FOR DART GAMES

CROSS-REFERENCE TO RELATED APPLICATIONS

This application claims benefit of U.S. Provisional Patent Application No. 60/435,574, "Touch Pad Scoring Apparatus for Dart Games", filed Dec. 19, 2002.

BACKGROUND OF THE INVENTION

The present invention relates generally to dart games and, more particularly, to a separate touch pad actuated apparatus for scoring a dart game.

The use of electronically scored dart games is well known in the art. Such electronically scored dart games include a dart board comprised of a series of independent polymeric dart board segments, the front face of each of which includes a plurality of circular openings for receiving and capturing the tip of a soft or plastic tipped dart. Upon receiving a plastic tipped dart, the applicable dart board segment moves rearwardly actuating one of a plurality of switches which identifies the particular segment of the dart board which has been hit by the soft tipped dart. The game includes microprocessor based circuitry for translating information concerning the segment hit by the dart into a score for the particular player whose turn it is. The score is then displayed on a suitable electronic display device. Such electronically scored dart games provide the capability of scoring many different types of dart games depending upon which game is selected to be played.

While such electronically scored dart games are widely accepted. In general, such dart games cannot be used with traditional steel tipped darts because of the potential damage which may be incurred as a result of being hit by the steel tips. As a result, for players who prefer to use steel tipped darts, scoring is typically accomplished utilizing pen and pencil or other antiquated means.

The present invention comprises a small hand-held or wall or table mountable apparatus which permits convenient electronic scoring of dart games using traditional steel tipped or any other type of darts including soft tipped darts, magnetic darts or the like.

BRIEF SUMMARY OF THE INVENTION

Briefly stated, in a first aspect the invention is a touch pad scoring apparatus for a dart game including a dart board and at least one dart. The touch pad scoring apparatus comprises: a housing; an electronic controller within the housing and a touch pad supported by the housing. The touch pad has a plurality of segments, and a plurality of sensors adapted to detect the presence of pressure applied to any one of the plurality of segments and to generate a signal corresponding to the segment to which pressure has been applied. The plurality of sensors are operatively connected to the controller. An electronic game memory and an electronic display are also operatively connected to the controller. Pressure applied to at least one touch pad segment corresponding to a dart board segment struck by a thrown dart causes a score associated with the struck dart board segment to be electronically tracked by the game memory. The controller causes a signal corresponding to the score to be output to the electronic display.

In a second aspect, the invention is a method of maintaining the score of a dart board game using an electronic touch pad scoring apparatus. The method comprises a step of providing an electronic touch pad scoring apparatus comprising: a housing; an electronic controller within the housing; a touch pad supported by the housing and having: a plurality of segments, and a plurality of sensors adapted to detect the presence of pressure applied to any one of the plurality of segments and to generate a signal corresponding to the segment to which pressure has been applied, the plurality of sensors being operatively connected to the controller; an electronic game memory operatively connected to the controller; and an electronic display operatively connected to the controller. The method further comprises steps of impacting a segment of a dart board with a dart; applying pressure to at least one touch pad segment corresponding to the dart board segment struck by the dart; sensing the pressure applied to the at least one touch pad segment; generating a signal corresponding to the at least one touch pad segment to which pressure is applied; transferring the signal to the controller; converting the signal to a numerical score; maintaining a cumulative score in the game memory based upon multiple numerical scores obtained in multiple rounds of the dart game; and displaying the cumulative score on the electronic display.

BRIEF DESCRIPTION OF THE SEVERAL VIEWS OF THE DRAWINGS

The following detailed description of a preferred embodiment of the invention will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
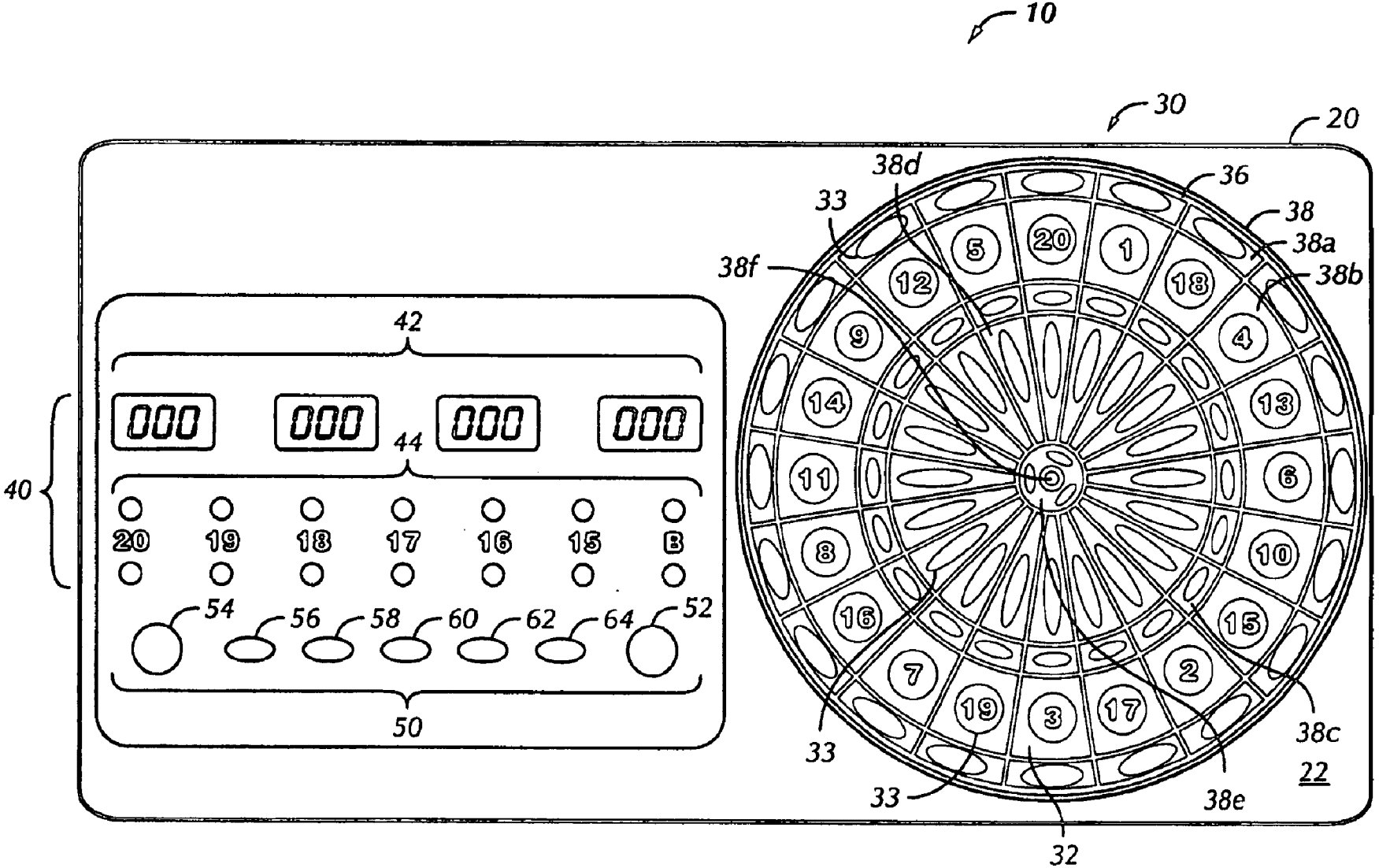
FIG. 1 is an front elevational view of a touch pad scoring apparatus in accordance with a first preferred embodiment of the present invention.

Certain terminology is used in the following description for convenience only and is not limiting. The words "right", "left", "top", and "bottom" designate directions in the drawings to which reference is made. The words "interior" and "exterior" refer to directions towards and away from, respectively, the geometric center of the touch pad scoring apparatus or designated parts thereof. The terminology includes the words above specifically mentioned, derivatives thereof and words of similar meaning.

Referring to the drawings, wherein like numerals represent like elements throughout the several figures, there is shown in FIG. 1 a front elevational view of a first embodiment of a touch pad scoring apparatus 10 for electronically scoring dart games. The apparatus first embodiment 10 is in the form of a stand alone housing 20 which is approximately 18 inches long, 8 inches wide and 1.5 inches high and which may be conveniently hand held or mounted on a wall or on a tabletop or other supporting surface. It should be clearly understood by those of ordinary skill in the art that the actual dimensions and size of the apparatus 10 should not be considered to be a limitation on the present invention. A touch pad cover 36, plurality of displays 40 and plurality of control buttons 50 are visible on a front face 22 of the housing 20.

A touch pad assembly 30 comprises the touch pad cover 36. The touch pad cover 36 includes a plurality of segments 32. In the first embodiment 10, the touch pad cover 36 forms a graphical representation 38 of a dart board, with each segment 32 corresponding to a segment of an actual dart board. Preferably, each segment 32 has a slightly raised portion 33, disposed over a pressure-sensitive sensor 34.

The dart board representation 38 comprises a first, segmented outer ring region 38*a*, a second segmented ring region 38*b* disposed radially inwardly of the first ring 38*a*, a third segmented ring region 38*c* disposed radially inwardly of the second ring 38*b*, and a fourth segmented ring region 38*d* disposed radially inwardly of the third ring 38*c*. The bull's eye area is comprised of two concentric regions: a central region 38*f*, a so-called "double bull's eye" region; and a outer ring region, a so-called "bull's eye" region 38*e*.

In scoring typical dart board games, different point values are ascribed to the various regions described above. For example, throwing a dart which impacts within region 38*b* will score a number of points corresponding to the numeral 1–20 indicated in the twenty segments forming region 38*b*. Darts impacting within region 38*d* also score a number of points corresponding to the number of the segment disposed radially outwardly of the impacted segment. Dart impacting within region 38*a* score a number of points equal to twice the number of the segment disposed radially inwardly of the impacted segment. Darts impacting within region 38*c* score a number of points equal to three times the number of the segment disposed radially outwardly of the impacted segment. Darts impacting within region 38*e* score 25 points. Darts impacting within region 38*f* score 50 points.

Sensors 34 may be activated, for example, by the pressure of a user's finger or by a stylus held by the user. In this manner, a player participating in a dart game may indicate to the apparatus 10 the location of impact of a dart thrown on the actual dartboard by touching the corresponding segment 32 of the touch pad assembly 30.

Figure 2:
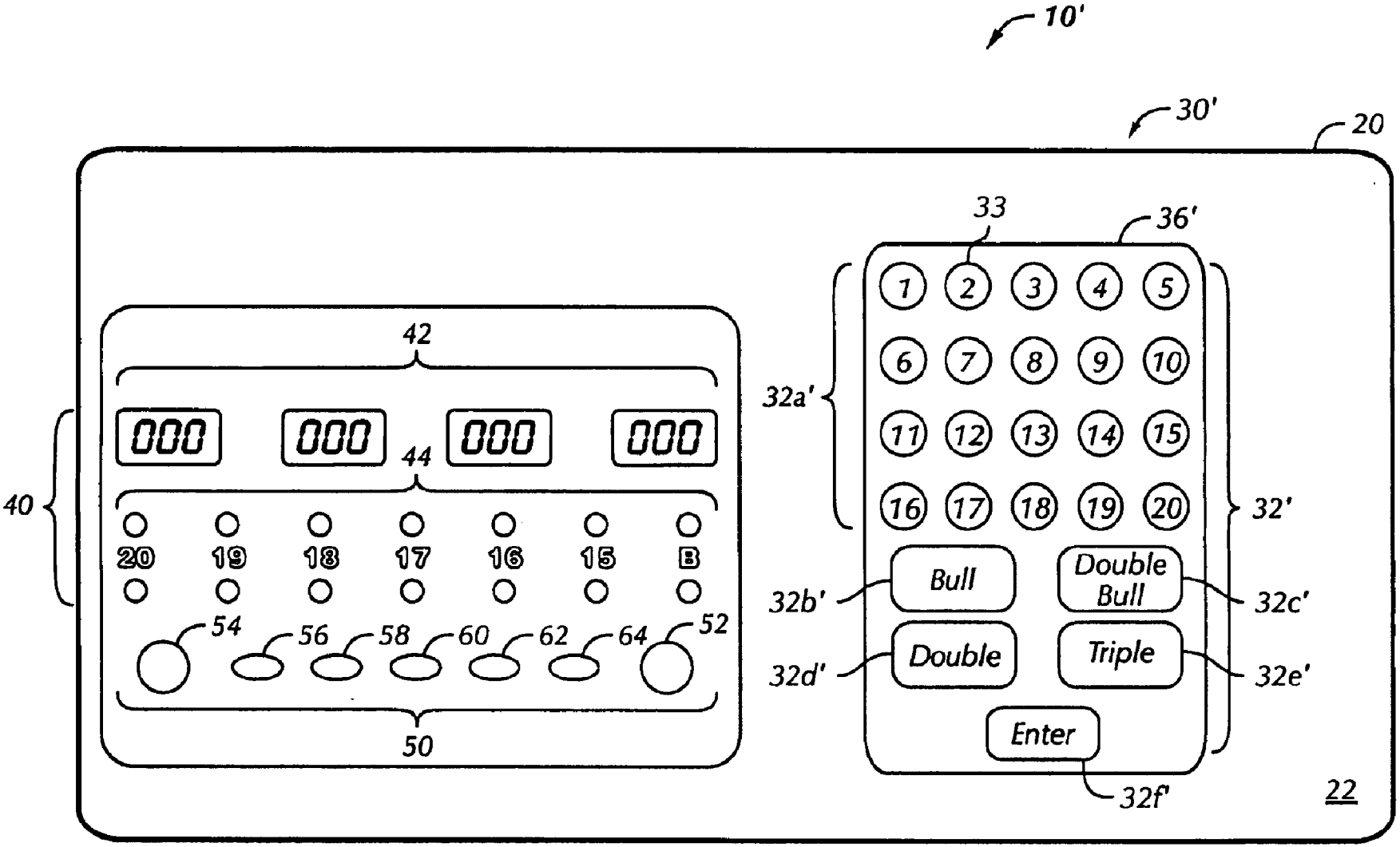
FIG. 2 is a front elevational view of a touch pad scoring apparatus in accordance with a second preferred embodiment of the present invention.

The touch pad cover 36 need not graphically represent a dart board. FIG. 2 illustrates a second embodiment of the touch pad scorer 10' with a touch pad assembly 30' having a touch pad cover 36' not in the form of a dartboard, but rather presenting touch pad segments 32 in the form of input keys 32'. More particularly, the input keys 32' include: a first set of input keys 32*a*' corresponding to the numbered segments 1-20 of region 38*b*; a second input key 32*b*' corresponding to the outer bull's eye region 38*e*; a third input key 32*c*' corresponding to the inner bull's eye region 38*f*; a fourth input key 32*d*', which in conjunction with the first set of input keys 32*a*', corresponds to the segments within region 38*a*; and a fifth input key 32*e*', which in conjunction with the first set of input keys 32*a*', corresponds to the segments within region 38*c*. A sixth input key 32*f*' is also preferably provided, initiating a score entry function.

The plurality of control buttons 50 allow a user to control operation of the touch pad scoring apparatuses 10 and 10'. The control buttons 50 include a power button 52 which may be engaged for applying power to the apparatus and its various circuitry and components. A start button 54 is provided to initiate playing of a game and to indicate when one player has completed his or her turn to begin scoring for the next player. A game menu button 56 is provided to permit players to select a particular style of dart game from a plurality of different dart games, the various scoring rules of which are stored in electronic memory. First and second quick select buttons 58 and 60 are employed for quick selection of certain games including cricket and cricket options (first button 58) and 301 and player handicaps (second button 60). A solo play/amend score button 62 is employed for identifying whenever a solo game is to be played or for amending a previously entered position of impact. A number of players/volume control button 64 is used for indicating the number of players of a game and for controlling the volume of sounds generated by the apparatuses 10 and 10'.

The plurality of displays 40 include four score displays 42 which in the present embodiments 10 and 10' are light emitting diode displays but could be liquid crystal or some other type of display. The score displays 42 are used for displaying the score of each player.

The displays 40 further include a plurality of segment specific lights 44. In certain types of dart games (for example, Cricket), striking specific segments of the dart board multiple times is significant and is an object of the game. The segment specific lights 44 are numbered to correspond to similarly numbered dart board segments (with the lights labeled "B" corresponding to the bull's eye). In the preferred embodiment, the displays 44 are light emitting diodes capable of emitting light of different colors. Specifically, the displays 44 emit green, amber and red light. The displays 44 change from green to amber to red as a corresponding segment on the dart board has been struck first, second and third times, respectively.

Figure 3:
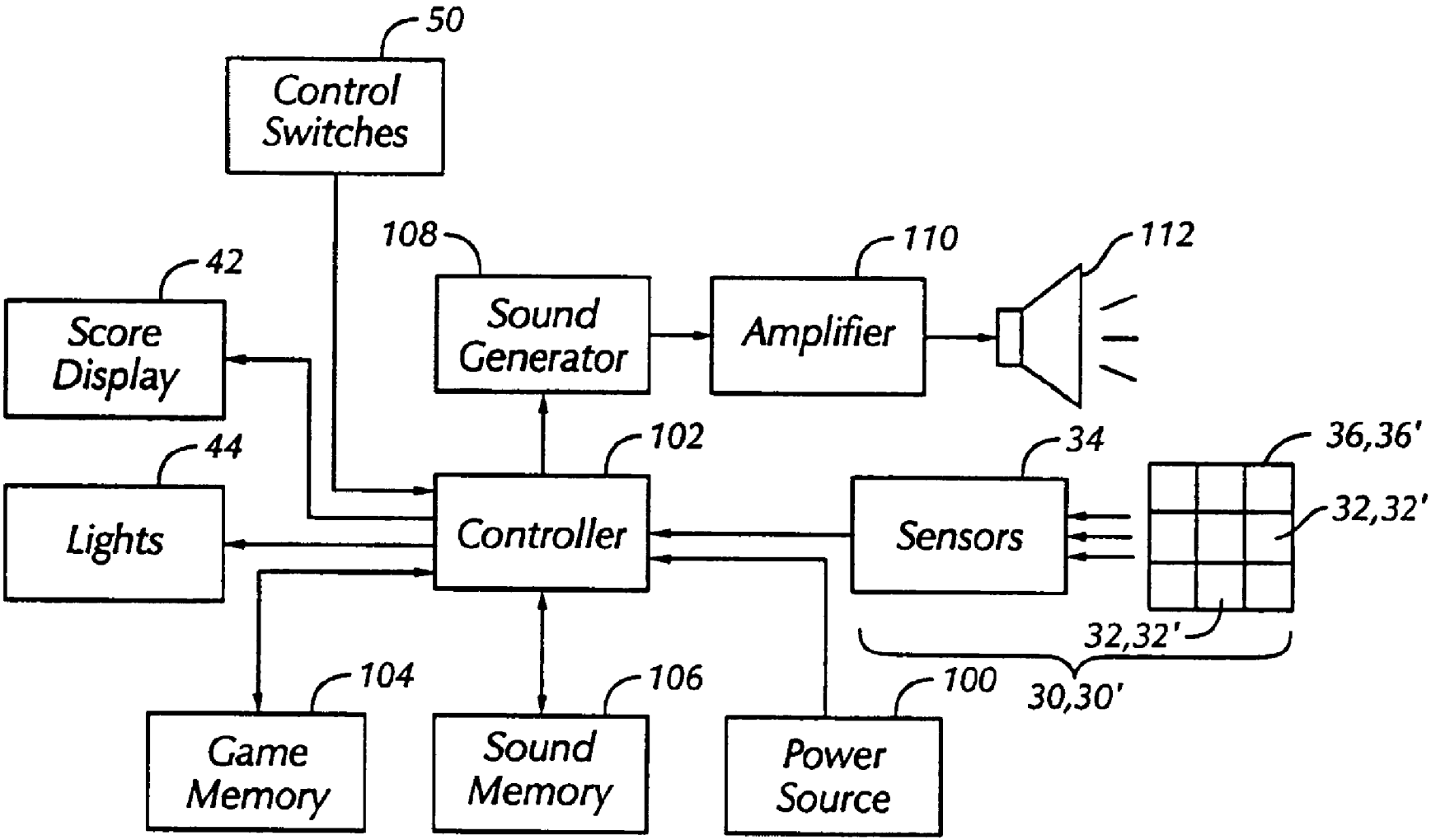
FIG. 3 is block diagram illustrating electronic and electromechanical components of the touch pad scoring apparatuses of FIGS. 1 and 2.

As shown in FIG. 3, each of the plurality of sensors 34 is operatively connected to circuitry including a controller 102 and game memory 104 to allow for scoring of a dart game. When a sensor 34 is pressed, a signal to the controller 102 is generated, and the controller 102 decodes the received signal to determine the identity of a touch pad segment 32, 32' to which pressure has been applied and to calculate, store in game memory 104 and then display a player's score on one of the score displays 42. The controller 102 and associated circuitry shown in FIG. 3 perform the necessary control, calculation and display functions in the same manner as is well known in the art and presently available in electronically scored dart games.

The touch pad scoring apparatuses 10 and 10' have the ability to generate sounds during use. A sound generator 108 is operatively connected to the controller 102. Sound passages, for example passages of speech or music, are preferably stored in digital form within sound memory 106. The controller 102 can select a sound passage from the sound memory 106 and can cause the sound passage to be audiblized via the sound generator 108, an amplifier 110 and a speaker 112.

Figure 4:
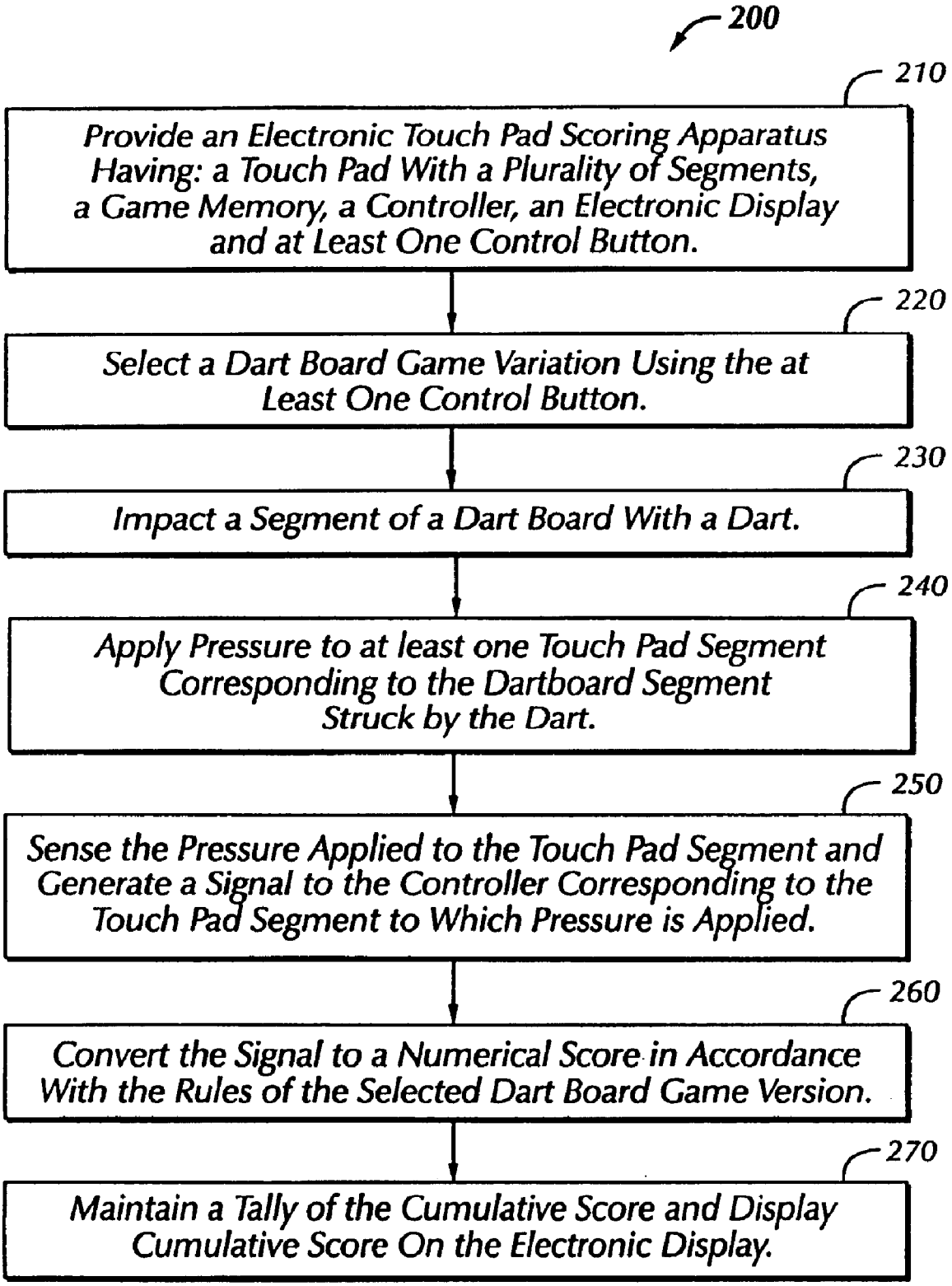
FIG. 4 is a flowchart illustrating a series of steps associated with a method of using the touch pad scoring apparatuses of FIGS. 1 and 2.

FIG. 4 illustrates a method 200 of using the touch pad scoring apparatuses 10 and 10'. The method 200 comprises an initial step 210 of providing the touch pad scoring apparatuses 10 and 10' as described herein above. In subsequent steps 220 through 270, a user selects a dart game variation using one of the game selection control buttons (56, 58 or 60) (step 220); the user impacts a segment of a dart board with a dart (230); the user applies pressure to the touch pad segment(s) 32 or 32' corresponding the dart board segment struck by the dart (240); the apparatus 10 or 10' senses the pressure applied to the touch pad segments 32, 32' and generates a signal corresponding to the touch pad segments 32, 32' to which pressure is applied (250); the apparatus 10 or 10' transfers the signal to the controller and converts the signal to a numerical score (260); and the apparatus 10 or 10' maintains a cumulative score in the game memory based upon multiple numerical scores obtained in multiple rounds of the dart game and displays the cumulative score on the electronic display.

From the foregoing it can be seen that the present invention comprises a touch pad scoring apparatus for convenient electronic scoring of dart games and especially well-suited for electronic scoring of dart games using traditional steel-tipped darts. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A touch pad scoring apparatus for a dart game including a dart board that is separate from the touch pad scoring device and at least one dart, the touch pad scoring apparatus comprising:

a stand alone housing;

an electronic controller within the housing;

a touch pad supported by the housing and having:

a graphical representation of the dart board on its face, a plurality of touch pad segments on the graphical representation of the dart board, each of the touch pad segments corresponding to an associated dart board segment, and a plurality of sensors adapted to detect the presence of pressure applied to any one of the plurality of touch pad segments and to generate a signal corresponding to the touch pad segment to which pressure has been applied, the plurality of sensors being operatively connected to the controller;

an electronic game memory operatively connected to the controller; and an electronic display operatively connected to the controller;

whereby:

pressure applied to at least one of the touch pad segments associated with the graphical representation of the dart board corresponding to the dart board segment struck by a thrown dart causes a score associated with the struck dart board segment to be electronically tracked by the game memory, and the controller causes a signal corresponding to the score to be output to the electronic display.

2. The touch pad scoring apparatus of claim 1, wherein the touch pad segments are in the form of a plurality of input keys.

3. The touch pad scoring apparatus of claim 1, wherein the game memory is capable of tracking scores of multiple players through multiple rounds of a game of darts.

4. The touch pad scoring apparatus of claim 3, further comprising a plurality of electronic displays.

5. The touch pad scoring apparatus of claim 1, further comprising a plurality of control buttons.

6. The touch pad scoring apparatus of claim 5, wherein the user may select one of a plurality of dart game variations using one of the plurality of control buttons, and wherein the controller and game memory are capable of tracking scores of multiple players in accordance with the rules of the selected dart game variation.

7. The touch pad scoring apparatus of claim 1, further comprising:

a sound generator operatively connected with the controller;

a sound memory storing information corresponding to at least one sound recording, the sound memory operatively connected to the controller;

wherein the controller causes the at least one sound recording to be audibilized upon occurrence of a triggering event.

8. The touch pad scoring apparatus of claim 7, wherein the triggering event is initial activation of power to the touch pad scoring apparatus.

9. The touch pad scoring apparatus of claim 7, further comprising:

a next turn control button, the next turn control button generating a signal to the controller indicating that a player's turn is complete, wherein the triggering event is activation of the next turn control button.

10. The touch pad scoring apparatus of claim 1, further comprising:

at least one light.

11. The touch pad scoring apparatus of claim 10, wherein the at least one light is capable of emitting light of a plurality of different colors.

12. The touch pad scoring apparatus of claim 11, wherein each of the plurality of different colors corresponds to a different condition occurring in the course of the dart game.

13. The touch pad scoring apparatus of claim 11, wherein the at least one light is a light emitting diode.

14. A method of maintaining the score of a dart board game using an electronic touch pad scoring apparatus that is separate from a dart board, the electronic touch pad scoring apparatus including a housing, an electronic controller within the housing, a touch pad supported by the housing with a plurality of touch pad segments mounted within a graphical dart board representation of the dart board, each touch pad segment associated with a corresponding dart board segment located on the graphical dart board representation, an electronic game memory connected to the controller and an electronic display connected to the controller, the method comprising the steps of:

a) impacting a dart board segment with a dart;

b) applying pressure to at least one touch pad segment on the graphical dart board representation corresponding to the dart board segment struck by the dart, the touch pad segment being separate from the dart board and being located on the graphical dart board representation;

c) sensing the pressure applied to the at least one touch pad segment;

d) generating a signal corresponding to the at least one touch pad segment to which pressure is applied;

e) transferring the signal to the controller;

f) converting the signal to a numerical score;

g) maintaining a cumulative score in the game memory based upon multiple numerical scores obtained in multiple rounds of the dart game; and h) displaying the cumulative score on the electronic display.

15. The method of claim 14 comprising the further step of:

i) selecting a dart game variation using a control button wherein the control button is mounted to the electronic scoring apparatus.

* * * * *